US011786778B2

(12) United States Patent
Ye

(10) Patent No.: US 11,786,778 B2
(45) Date of Patent: Oct. 17, 2023

(54) STRENGTH TRAINING MACHINE

(71) Applicant: Guangzhou Yuandong Smart Sports Technology Co. Ltd., Guangzhou (CN)

(72) Inventor: Quansheng Ye, Guangzhou (CN)

(73) Assignee: Guangzhou Yuandong Smart Sports Technology Co. Ltd., Guangzhou (CN)

( * ) Notice: Subject to any disclaimer, the term of this patent is extended or adjusted under 35 U.S.C. 154(b) by 0 days.

(21) Appl. No.: 18/114,327

(22) Filed: Feb. 27, 2023

(65) Prior Publication Data

US 2023/0201652 A1 Jun. 29, 2023

Related U.S. Application Data

(63) Continuation of application No. PCT/CN2021/105277, filed on Jul. 8, 2021.

(30) Foreign Application Priority Data

Aug. 31, 2020 (CN) ..... 202010899237.3
Aug. 31, 2020 (CN) ..... 202021871252.9

(51) Int. Cl.
*A63B 21/00* (2006.01)
*A63B 21/22* (2006.01)

(52) U.S. Cl.
CPC ..... *A63B 21/4033* (2015.10); *A63B 21/153* (2013.01); *A63B 21/22* (2013.01);
(Continued)

(58) Field of Classification Search
CPC ..... A63B 23/03541; A63B 23/0488; A63B 21/0557; A63B 21/0552; A63B 21/0428;
(Continued)

(56) References Cited

U.S. PATENT DOCUMENTS 3,664,666 A * 5/1972 LLoyd ..... A63B 17/00 482/121
4,478,413 A * 10/1984 Siwula ..... A63B 21/0455 482/123

(Continued)

FOREIGN PATENT DOCUMENTS

CN 201139901 Y 10/2008
CN 201760036 U 3/2011

(Continued)

OTHER PUBLICATIONS

International Application No. PCT/CN2021/105277, International Search Report and Written Opinion dated Sep. 28, 2021, 14 pages.

(Continued)

*Primary Examiner* — Andrew S Lo
*Assistant Examiner* — Andrew M Kobylarz
(74) *Attorney, Agent, or Firm* — Zhong Law, LLC

(57) ABSTRACT

A strength training machine includes a first bracket, a second bracket and a first connection assembly, in which a cavity of a first end of the first bracket and a cavity of a first end of the second bracket are provided with a counterweight mechanism, a bottom of the first end of the first bracket and a bottom of the first end of the second bracket are provided with a first sliding pad or wheels, and at least two foot pads, a side wall of the first end of the first bracket and a side wall of the first end of the second bracket are provided with a second sliding pad or wheels; the first connection assembly includes a connection handle, a second end of the first bracket and a second end of the second bracket are connected through the connection handle.

20 Claims, 11 Drawing Sheets

(52) U.S. Cl.
CPC ... *A63B 2208/0204* (2013.01); *A63B 2209/08* (2013.01); *A63B 2210/50* (2013.01)

(58) Field of Classification Search
CPC ..... A63B 22/203; A63B 2071/0072; A63B 22/205; A63B 2022/00; A63B 21/4033; A63B 21/153; A63B 21/22; A63B 2208/0204; A63B 2209/08; A63B 2210/50
See application file for complete search history.

(56) References Cited

U.S. PATENT DOCUMENTS

| | | | | |
|---|---|---|---|---|
| 6,422,981 | B1 * | 7/2002 | Riser | A63B 23/03575 482/142 |
| 7,892,152 | B1 * | 2/2011 | Teng | A63B 23/03541 482/79 |
| 9,011,302 | B2 * | 4/2015 | Lalaoua | A63B 23/04 482/121 |
| 9,630,056 | B2 * | 4/2017 | Rao | A63B 71/0054 |
| 10,434,355 | B1 * | 10/2019 | Kipnis | A63B 21/4031 |
| 2005/0075205 | A1 | 4/2005 | Chen | |
| 2014/0228184 | A1 * | 8/2014 | Kamenskikh | A63B 21/154 482/122 |
| 2018/0117396 | A1 | 5/2018 | Engelfried, Jr. | |
| 2018/0236295 | A1 | 8/2018 | Oltorik | |
| 2022/0257995 | A1 * | 8/2022 | Goldberg | A63B 23/1209 |

FOREIGN PATENT DOCUMENTS

| | | | |
|---|---|---|---|
| CN | 204637416 | U | 9/2015 |
| CN | 205924889 | U | 2/2017 |
| CN | 206081501 | U | 4/2017 |
| CN | 108905050 | A | 11/2018 |
| CN | 208943390 | U | 6/2019 |
| CN | 110270048 | A | 9/2019 |
| CN | 209644441 | U | 11/2019 |
| CN | 110893268 | A | 3/2020 |
| CN | 210728532 | U | 6/2020 |
| CN | 211215243 | U | 8/2020 |
| CN | 111991748 | A | 11/2020 |
| CN | 212854440 | U | 4/2021 |
| KR | 20120130692 | A | 12/2012 |
| WO | 2020014667 | A1 | 1/2020 |

OTHER PUBLICATIONS

Chinese Patent Office, Request for Patent Invalidation issued in Application No. 202021871252.9 dated Jun. 9, 2023, 192 pages.

* cited by examiner

STRENGTH TRAINING MACHINE

The present application is a continuation of PCT/CN2021/105277 filed on Jul. 8, 2021, which claims the priority of Chinese patent application no. 202021871252.9 with the title of "STRENGTH TRAINING MACHINE", filed with China National. Intellectual Property Administration (CNIPA) on Aug. 31, 2020, and claims the priority of Chinese patent application no. 202010899237.3 with the title of "STRENGTH TRAINING MACHINE", filed with CNIPA on Aug. 31, 2020. The entire contents of the above-mentioned applications are incorporated by reference in the present disclosure.

TECHNICAL FIELD

The present disclosure relates to the field of fitness equipment, in particular, to a strength training machine.

BACKGROUND

With the continuous improvement of living standards, people pay more and more attention to their health. Therefore, various types of fitness equipment also become popular in people's life.

Conventional strength training machines may include a left bracket and a right bracket, both of the left bracket and the right bracket are provided with counterweight blocks, and the left bracket and the right bracket are connected by a rotating shaft, thereby realizing the folding of the strength training machine so as to facilitate the storage of the strength training machine. However, when the above-described strength training machines are being folded, the counterweight blocks are likely to shake, which is inconvenient for the folding operation of the strength training machine.

SUMMARY

The present disclosure provides a strength training machine, which can be folded with a single hand and thus convenient for the folding operation.

The present disclosure provides a strength training machine, comprising a first bracket, a second bracket and a first connection assembly, wherein the first connection assembly comprises a connection handle, a first end of the first bracket and a first end of the second bracket are provided with a counterweight mechanism, a second end of the first bracket and a second end of the second bracket are connected through the connection handle, so that the first bracket and the second bracket can be switched between a folded state and an unfolded state; in the unfolded state, the two counterweight mechanisms are located in a same plane; one of a bottom of the first bracket and a bottom of the second bracket is provided with a push rod structure, and the push rod structure is used to apply a pushing force to the other bottom, so as to separate the first bracket and the second bracket.

Optionally, the push rod structure comprises a drive assembly, a swing rod and a support base that are connected in sequence, the drive assembly and the support base are arranged on one of the first bracket and the second bracket, and the drive assembly drives the swing rod to rotate around the support base, so that the swing rod applies a pushing force to the other bracket.

Optionally, the drive assembly is a motor, and an output shaft of the motor is connected with the swing rod; or, the drive assembly comprises a pull rod, a pull cable and a fixed base, the fixed base is connected with the first bracket, the pull rod is arranged on the fixed base, and the pull rod is connected with the swing rod through the pull cable.

Optionally, a positioning groove is provided on the support base, the swing rod is hinged in the positioning groove, and the positioning groove is used to limit a rotation angle of the swing rod.

Optionally, a notch of the positioning groove faces the second end of the first bracket, the swing rod is V-shaped, the swing rod is located in the positioning groove, and a bending position of the swing rod is hinged with the positioning groove.

Optionally, the second end of the first bracket includes at least two first connection pieces, and the second end of the second bracket includes at least two second connection pieces, the first connection pieces and the second connection pieces are in one-to-one correspondence; the connection handle comprises a handle main body, both ends of the handle main body include a connection part, and each the connection part is respectively hinged with the first connection piece and the second connection piece that are opposite to each other, and there is a gap between the corresponding first connection piece and second connection piece.

Optionally, the first connection assembly further comprises two third connection pieces, and the third connection pieces are hinged with the first connection piece and the second connection piece that are located on an outer side.

Optionally, the first connection piece and/or the second connection piece on the outer side are provided with a limiting piece, and the limiting piece abuts against a side surface of the third connection piece facing an upper surface of the first bracket or an upper surface of the second bracket, to avoid reversely folding the first bracket and the second bracket.

Optionally, the strength training machine further comprises a second connection assembly, the second connection assembly is used to connect the first bracket and the second bracket in the folded state.

Optionally, the second connection assembly comprises a magnetic element and a magnetic adsorption piece, one of the magnetic element and the magnetic adsorption piece is located on the bottom of the first bracket, and the other is located on the bottom of the second bracket, and in the folded state, the magnetic element is absorbed to the magnetic adsorption piece; or, the second connection assembly comprises a buckle and a slot matching the buckle, one of the buckle and the slot is located on the bottom of the first bracket, and the other is located on the bottom of the second bracket, in the folded state, the buckle is engaged with the slot.

Optionally, the second connection assembly comprises a sleeve, a guide shaft, a positioning shaft and a cushioning piece, the positioning shaft is connected with the first bracket or the second bracket, the guide shaft and the positioning shaft are coaxially connected, the cushioning piece and the sleeve are sleeved on the guide shaft, the magnetic element is connected with a first end of the sleeve, the cushioning piece abuts against a second end of the sleeve, and the sleeve can slide along an axial direction of the guide shaft.

Optionally, the second connection assembly and the push rod structure are set adjacent to each other.

Optionally, the first end of the first bracket and the first end of the second bracket are symmetrically provided with a pulling assembly, the pulling assembly comprises a handle assembly and the counterweight mechanism, the counterweight mechanism comprises a resistance adjusting assembly and a drive wheel, the handle assembly comprises a pulling piece, a first end of the pulling piece is used for an user to apply a pulling force, and a second end of the pulling piece is fixed on the drive wheel, and the drive wheel rotates under the driving of the resistance adjusting assembly, so that the pulling piece is wound on a wheel surface of the drive wheel and generates a counterweight pulling force.

Optionally, the counterweight mechanism further comprises a guide unit, the guide unit comprises a support frame, and the drive wheel and the first end of the pulling piece are respectively located on opposite sides of the support frame, the support frame is provided with an avoidance hole, and the pulling piece is passed through the avoidance hole.

Optionally, the guide unit further comprises a first guide wheel and at least one second guide wheel, the first guide wheel and the at least one second guide wheel are supported on opposite sides of the pulling piece, the first guide wheel and the at least one second guide wheel are respectively located on opposite sides of the support frame, the drive wheel and the first guide wheel are located on a same side of the support frame, the first end of the pulling piece and the at least one second guide wheel are located on a same side of the support frame.

Optionally, the pulling piece is a tension belt or a pull rope.

Optionally, the pulling assembly further comprises a load bar, and the first ends of the two pulling pieces are detachably connected with the load bar.

Optionally, the pulling assembly further comprises at least two fixing assemblies, the at least two fixing assemblies are used to fix the first end of the pulling piece to the load bar.

Optionally, each of the fixing assemblies comprises a fixing sleeve and a fastening piece, the fixing sleeve is sleeved on the load bar, and the fastening piece is used to fix the fixing sleeve on the load bar.

Optionally, the pulling assembly further comprises a housing, the counterweight mechanism and a part of the pulling piece are located in the housing, and the housing is connected with the first bracket or the second bracket;

the housing includes an entrance/exit hole, and a first end of the pulling piece protrudes out of the housing through the entrance/exit hole.

Optionally, a bottom and/or a side wall of the housing include a sliding pad or wheels.

According to the strength training machine provided by the present disclosure, by the arrangement of the first bracket and the second bracket, both of the first end of the first bracket and the first end of the second bracket are provided with a counterweight mechanism, the second end of the first bracket and the second end of the second bracket are connected through the connection handle, and by pulling the connection handle with one hand, the second end of the first bracket and the second end of the second bracket can rotate around the connection handle respectively, and concurrently, under the gravity of the counterweight mechanism connected to the first end of the first bracket and the first end of the second bracket, the second end of the first bracket and the second end of the second bracket are gradually raised with the connection handle, and the first bracket and the second bracket are gradually folded up to a folded state in which the first bracket and the second bracket are arranged back to back. The folding of the strength training machine is realized by one hand, and the operation is convenient and the structure is simple. In addition, one of the bottom of the first bracket and the bottom of the second bracket is provided with a push rod structure, so as to facilitate the separation of the first bracket and the second bracket.

BRIEF DESCRIPTION OF THE DRAWINGS

To illustrate more clearly the technical solutions in embodiments of the present disclosure, the following will briefly introduce the drawings that are used in the description of the embodiments or the prior art. Obviously, the accompanying drawings in the following description are some embodiments of the present disclosure. Those skilled in the art can also obtain other drawings based on these drawings without creative work.

DESCRIPTION OF THE PREFERRED EMBODIMENTS

Figure 1:
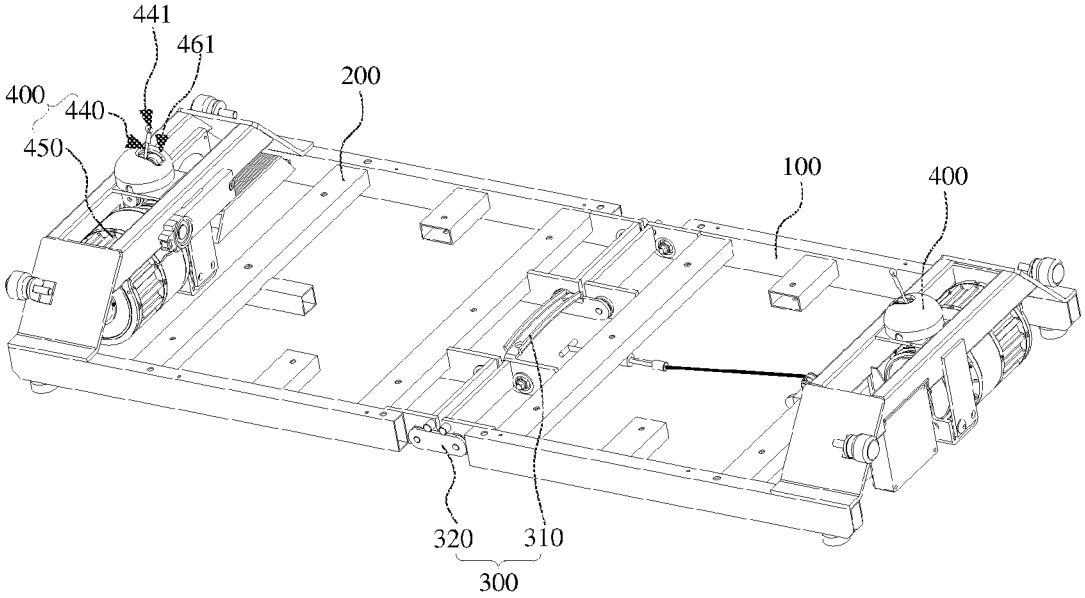
FIG. 1 is a structural diagram of a strength training machine provided by an embodiment of the present disclosure in an unfolded state.

To make the purpose, technical solutions and advantages of the present disclosure clearer, the technical solutions in the embodiments of the present disclosure will be described in more detail hereinafter in conjunction with the drawings in preferred embodiments of the present disclosure. In the drawings, the same or similar reference numerals denote the same or similar components or components having the same or similar functions throughout. The described embodiments are a part of embodiments of the present disclosure, not all thereof. The embodiments described hereinafter by referring to the figures are exemplary, and are intended to explain the present disclosure, and should not be construed as limiting the present disclosure. Based on the embodiments in the present disclosure, all other embodiments obtained by those skilled in the art without creative efforts fall within the claimed scope of the present disclosure. Hereinafter, embodiments of the present disclosure will be described in detail in conjunction with the accompanying drawings.

In the description of the present disclosure, it should be noted that, unless otherwise clearly stipulated and limited, the terms "installed", "connected with" and "connected" should be understood in a broad sense. For example, they can be fixedly connected, or indirectly connected through an intermediate medium, which can be the internal communication of two elements or the interaction relationship between two elements. For those skilled in the art, the concrete meaning of the above-mentioned terms in the present disclosure can be understood under concrete circumstances.

In the description of the present disclosure, it should be understood that the orientation or positional relationship indicated by the terms "upper", "lower", "front", "rear", "vertical", "horizontal", "top", "bottom", "inner", "outer" is based on the orientation or positional relationship shown in the drawings, and is only for the convenience of describing the present disclosure and simplifying the description, rather than indicating or implying that the referred device or element must include a specific orientation, constructed and operated in a particular orientation and therefore should not be understood as limiting the present disclosure.

The terms "first", "second", and "third" (if any) in the description, claims and the above drawings of the present disclosure are used to distinguish similar objects and not necessarily to describe a specific order or priority. It should be understood that the data thus used are interchangeable under appropriate circumstances such that the embodiments of the present disclosure described herein can be practiced in sequences other than those illustrated or described herein.

Furthermore, the terms "comprise"/"include" and "include", as well as any variations thereof, are intended to cover a non-exclusive inclusion, for example, a process, method, system, product or maintenance tool comprising a series of steps or units need not be limited to the expressly listed, but other steps or elements not explicitly listed or inherent to the process, method, product or maintenance tool may be included.

The existing strength training machines with folding function adopt the structure of a rotating shaft or a hinge, so as to realize the folding of the strength training machine, thereby facilitating the storage of the strength training machine. However, when the above-described strength training machines are being folded, the assistance of both hands, or a hand and a foot is required to complete the folding, which is inconvenient to operate. To solve the above-identified and other deficiencies, the present disclosure provides a strength training machine, which can be folded with one hand and is convenient for folding.

Hereinafter, the present disclosure will be described in detail using specific examples.

Figure 2:
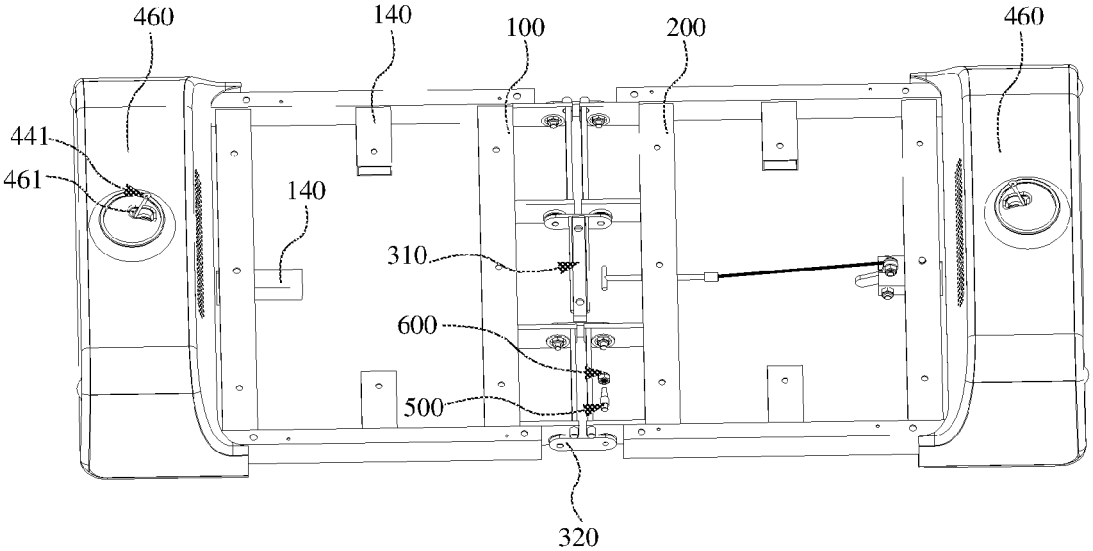
FIG. 2 is a structural diagram of the strength training machine provided by the embodiment of the present disclosure from another view in the unfolded state.
Figure 3:
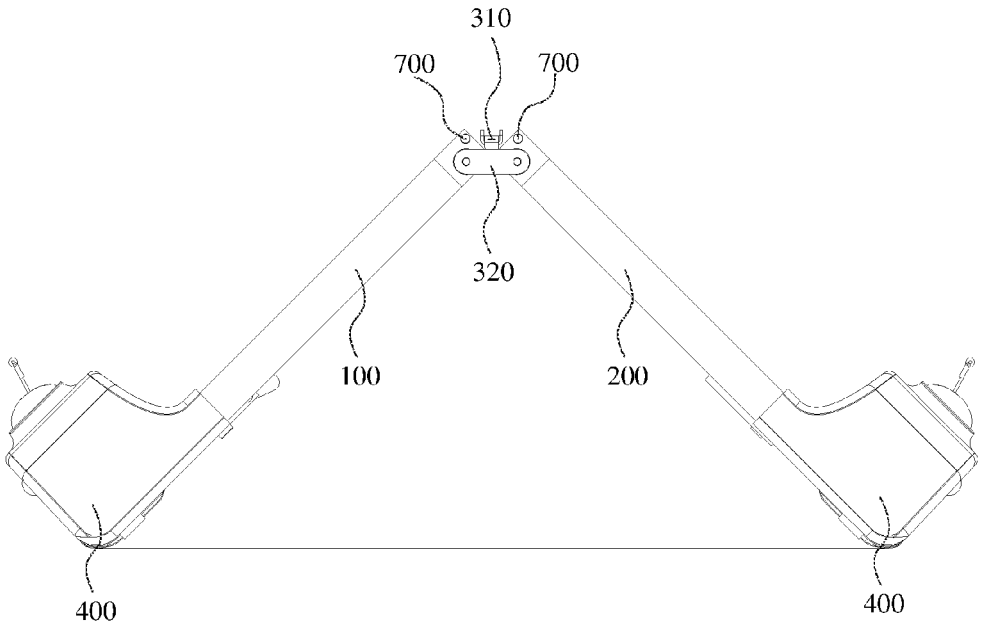
FIG. 3 is a diagram of relative positions of the first bracket and the second bracket in the strength training machine provided by the embodiment of the present disclosure.
Figure 4:
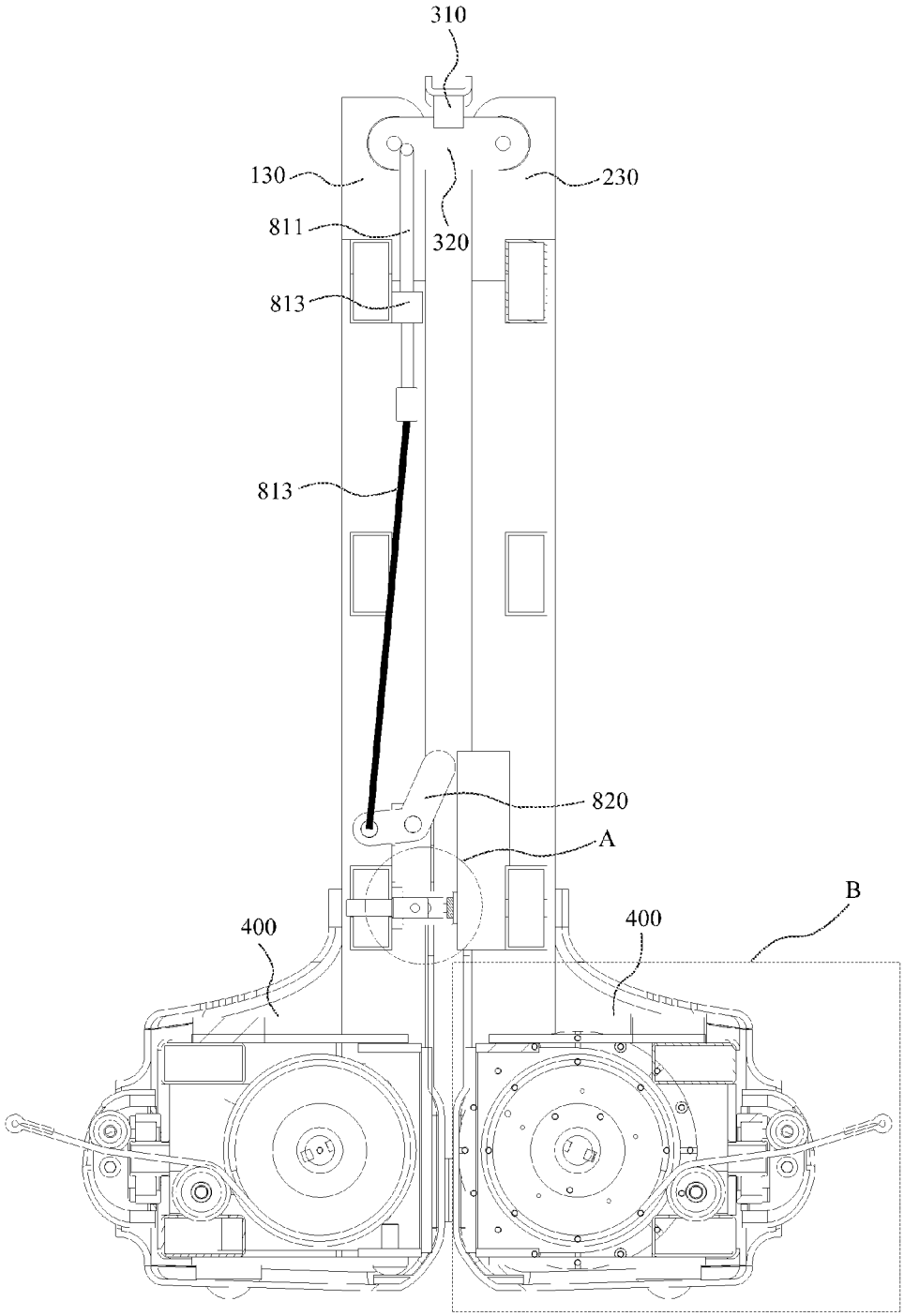
FIG. 4 is a structural diagram of the strength training machine provided by the embodiment of the present disclosure in a folded state.
Figure 5:
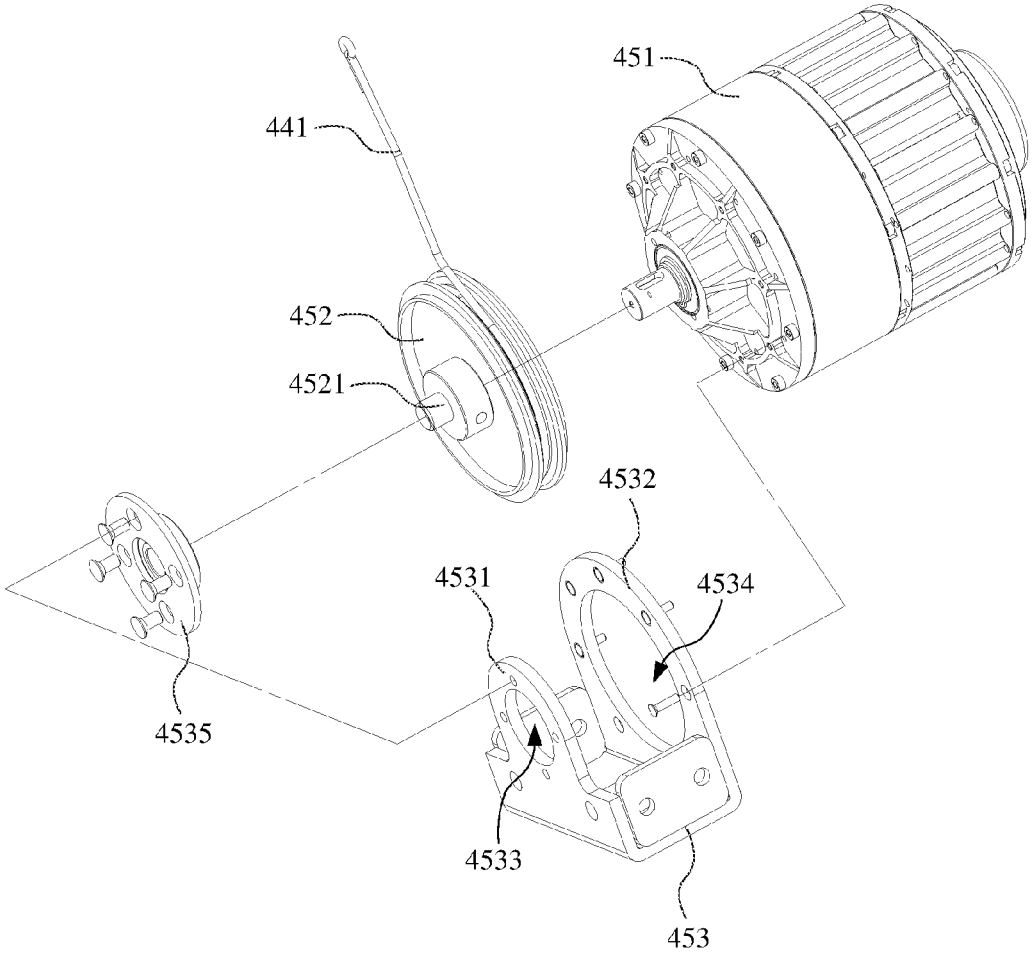
FIG. 5 is a structural diagram of a counterweight mechanism in the strength training machine provided by the embodiment of the present disclosure.
Figure 6:
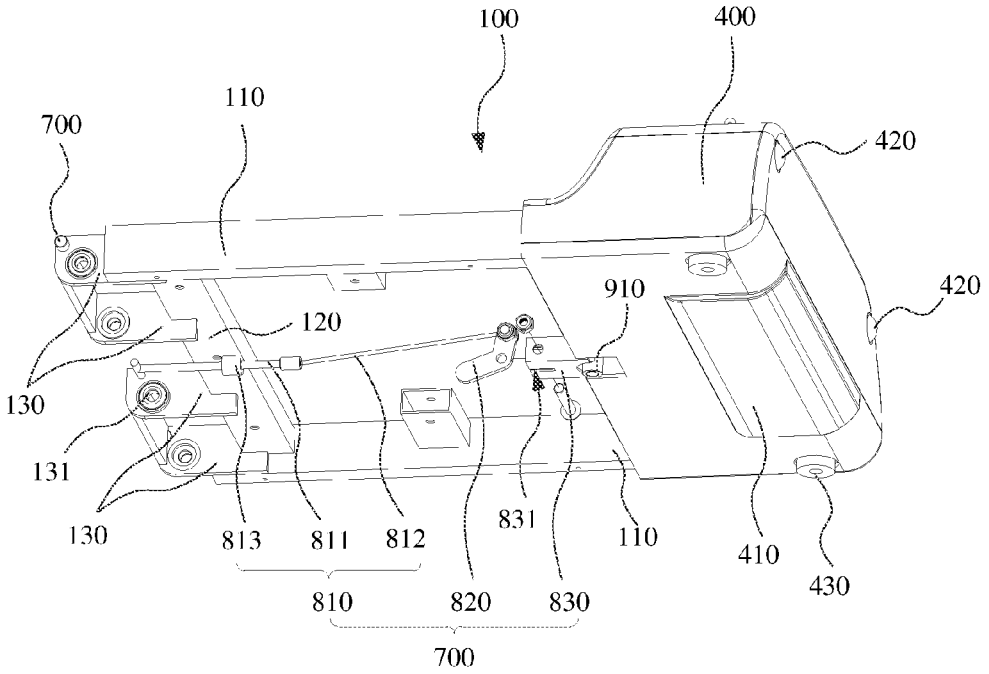
FIG. 6 is a structural diagram of a first bracket in the strength training machine provided by the embodiment of the present disclosure.
Figure 7:
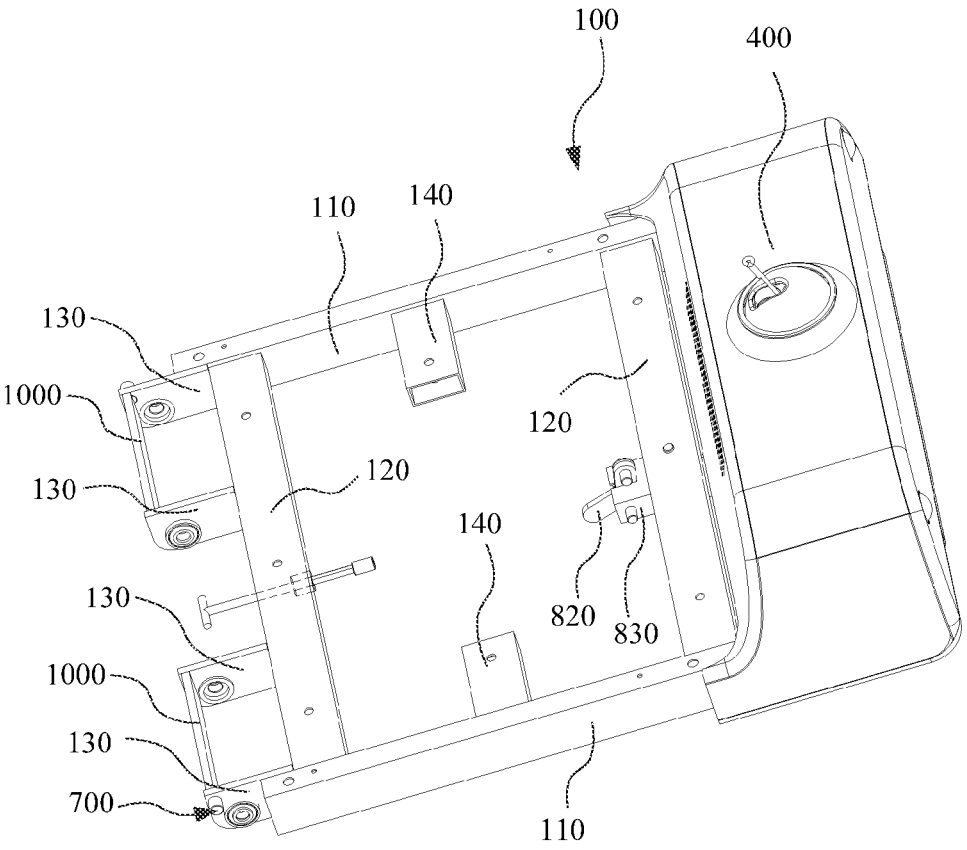
FIG. 7 is a structural diagram of the first bracket in the strength training machine provided by the embodiment of the present disclosure from another view.
Figure 8:
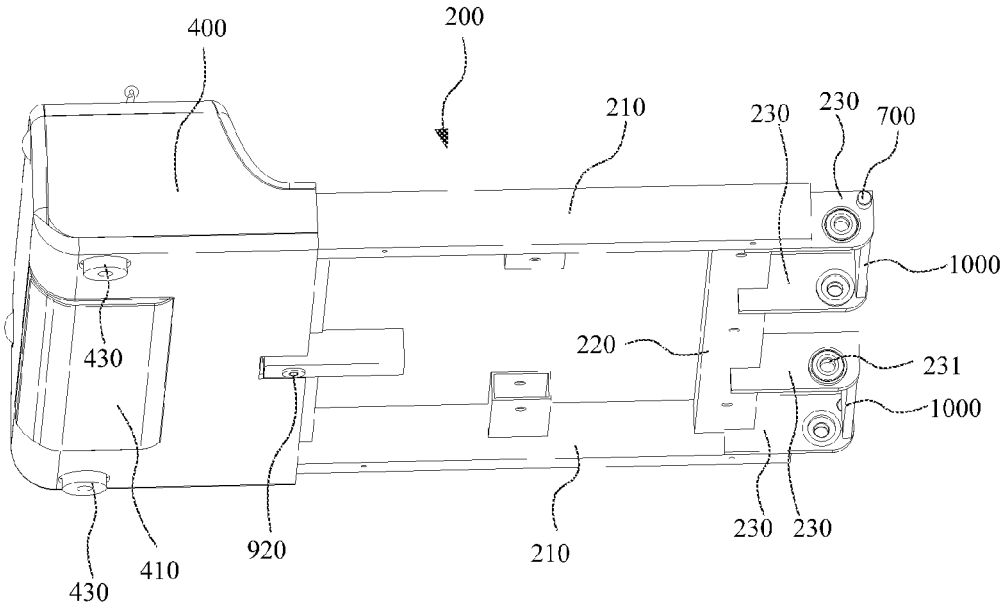
FIG. 8 is a structural diagram of a second bracket in the strength training machine provided by the embodiment of the present disclosure.

FIG. 1 is a structural diagram of a strength training machine provided by an embodiment of the present disclosure in an unfolded state. FIG. 2 is a structural diagram of the strength training machine provided by the embodiment of the present disclosure from another view in the unfolded state. FIG. 3 is a diagram of relative positions of the first bracket and the second bracket in the strength training machine provided by the embodiment of the present disclosure. FIG. 4 is a structural diagram of the strength training machine provided by the embodiment of the present disclosure in a folded state. FIG. 5 is a structural diagram of a counterweight mechanism in the strength training machine provided by the embodiment of the present disclosure. FIG. 6 is a structural diagram of a first bracket in the strength training machine provided by the embodiment of the present disclosure. FIG. 7 is a structural diagram of the first bracket in the strength training machine provided by the embodiment of the present disclosure from another view. FIG. 8 is a structural diagram of a second bracket in the strength training machine provided by the embodiment of the present disclosure. Referring to FIGS. 1 to 8, the strength training machine provided by the embodiment of the present disclosure includes a first bracket 100, a second bracket 200 and a first connection assembly 300.

Therein, the first connection assembly 300 comprises a connection handle 310. A first end of the first bracket 100 and a first end of the second bracket 200 are symmetrically provided with a pulling assembly 400, the pulling assembly 400 includes a handle assembly 440 and a counterweight mechanism 450, and the counterweight mechanism 450 includes a resistance adjusting assembly 451 and a drive wheel 452. The handle assembly 440 includes a pulling piece 441, a first end of the pulling piece 441 is used for a user to apply a pulling force, and a second end of the pulling piece 441 is fixed on the drive wheel 452. The drive wheel 452 rotates under the driving of the resistance adjusting assembly 451, so that the pulling piece 441 is wound on a wheel surface of the drive wheel 452 and generates a counterweight pulling force.

A second end of the first bracket 100 and a second end of the second bracket 200 are hinged through the connection handle 310, so that the first bracket 100 and the second bracket 200 are switched between a folded state and an unfolded state. Therein, in the folded state, the first bracket 100 and the second bracket 200 are arranged back-to-back, that is, the bottoms of the two pulling assemblies 400 abut against each other. In the unfolded state, the first bracket 100 and the second bracket 200 are arranged side by side, whereas the two pulling assemblies 400 are located in a same plane, and the first bracket 100 and the second bracket 200 are located in a same plane.

According to the embodiment, the first bracket 100 and the second bracket 200 are respectively used to support the pulling assembly 400 connected thereto. Therein, the first bracket 100 and the second bracket 200 may include a shape of a rectangular frame. The structures of the first bracket 100 and the second bracket 200 may be identical.

Figure 12A:
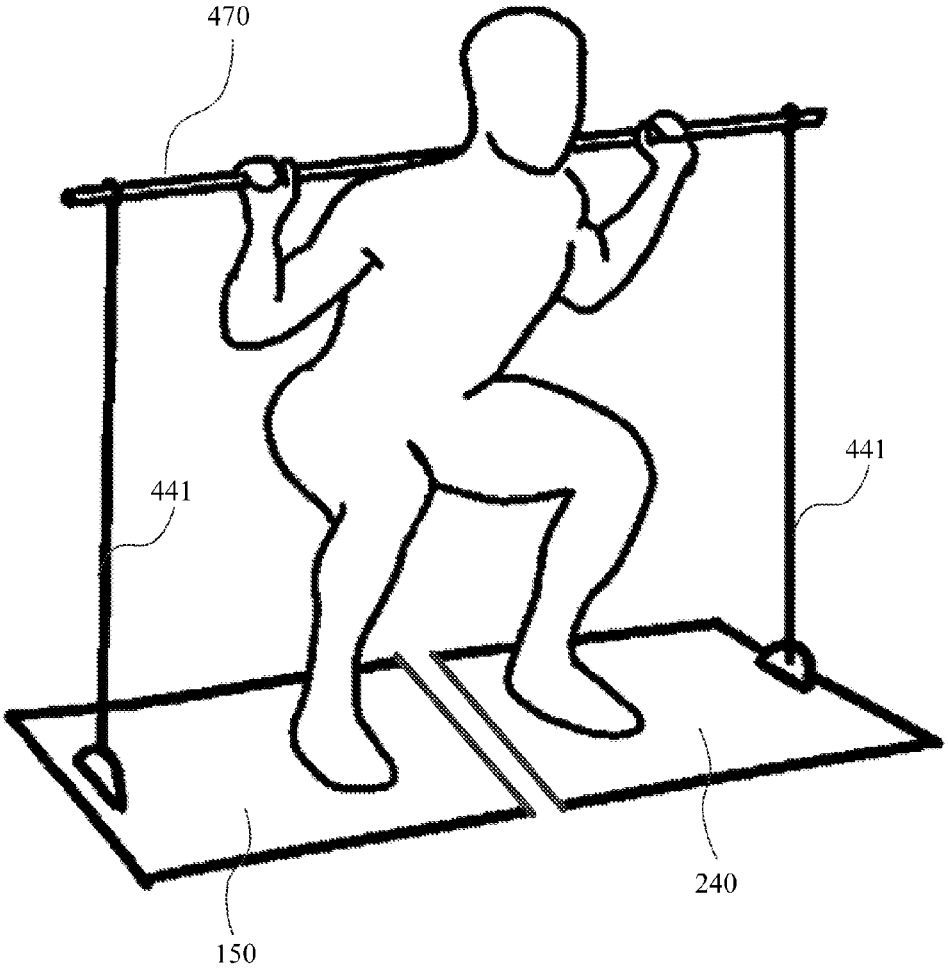
FIG. 12*a* and FIG. 12*b* are diagrams of the strength training machine provided by the embodiment of the present disclosure in use states.
Figure 12B:
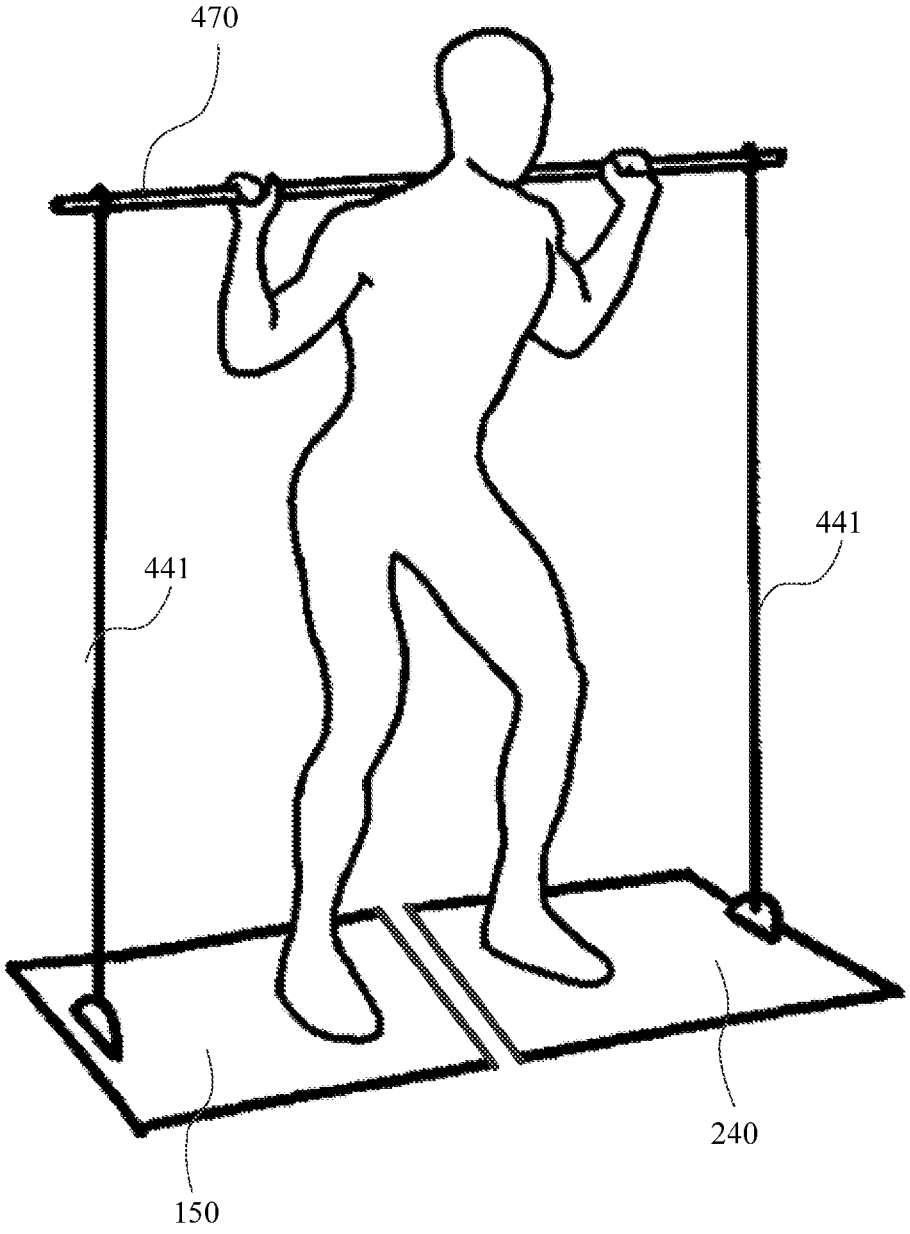

FIGS. 12*a* and 12*b* are diagrams of the strength training machine provided by the embodiment of the present disclosure in use states. Referring to FIGS. 1, 12*a* and 12*b*, in particular, the first bracket 100 may include at least two first support rods 110 and a first connection rod 120 connecting to the two first support rods 110. To facilitate the user to stand on the first bracket 100, a first support plate 150 may be covered on the first support rod 110 and the first connection rod 120. Correspondingly, the second bracket 200 may include at least two second support rods 210 and a second connection rod 220 connecting the two second support rods 210. To facilitate the user to stand on the second bracket 200, a second support plate 240 may be covered on the second support rod 210 and the second connection rod 220. The user is supported by the first support plate 150 and the second support plate 240.

According to the embodiment, the resistance adjusting assembly 451 may be a motor, and the motor can simulate a counterweight. The motor drives the drive wheel 452 to rotate, so that the pulling piece 441 is wound on the wheel surface of the drive wheel 452 to generate a counterweight pulling force. In this way, when folding or unfolding the strength training machine, it is unlikely to shake. At the same time, when the counterweight mechanism 450 performs counterweight adjustment, the counterweight size of the counterweight mechanism 450 is adjusted accurately, and the counterweights of the two pulling assemblies 400 can be adjusted separately according to different requirements of users.

FIGS. 1 and 2 are schematic diagrams of the unfolded state of the strength training machine provided by the embodiment. When the strength training machine is unfolded, the first bracket 100 and the second bracket 200 are arranged side by side, and the user pulls the pulling piece 441 to realize the strength training. When the strength training machine needs to be folded, the connection handle 310 is pulled with one hand, the second end of the first bracket 100 and the second end of the second bracket 200 rotate around the connection handle 310 respectively, and meanwhile, under the gravity, the pulling assemblies 400 connected to the first end of the first bracket 100 and the first end of the second bracket 200 makes the second end of the first bracket 100 and the second end of the second bracket 200 gradually rise with the connection handle 310, to form the state of FIG. 3. The first bracket 100 and the second bracket 200 are gradually folded until they are folded into the folded state of the strength training machine shown in FIG. 4. The first bracket 100 and the second bracket 200 are arranged back to back, thereby facilitating the storage of the strength training machine.

According to the strength training machine provided by the present disclosure, the first bracket 100 and the second bracket 200 are arranged, both of the first end of the first bracket 100 and the first end of the second bracket 200 are symmetrically provided with the pulling assemblies 400, the pulling assemblies 400 simulate a counterweight through the resistance adjusting assembly 451, and the resistance adjusting assembly 451 drives the drive wheel 452 to rotate, so that the pulling piece 441 is wound on the wheel surface of the drive wheel 452 and generates a counterweight pulling force. In this way, when folding or unfolding the strength training machine, it is unlikely to shake. The second end of the first bracket 100 and the second end of the second bracket 200 are hinged through the connection handle 310, and by pulling the connection handle 310 with one hand, the second end of the first bracket 100 and the second end of the second bracket 200 can be rotated around the connection handle 310 respectively, and meanwhile, under the gravity, the pulling assemblies 400 connected to the first end of the first bracket 100 and the first end of the second bracket 200 make the second end of the first bracket 100 and the second end of the second bracket 200 are gradually raised with the connection handle 310, and the first bracket 100 and the second bracket 200 are gradually folded up to a folded state in which the first bracket 100 and the second bracket 200 are arranged back to back. The folding of the strength training machine is realized by a single hand, and the operation is convenient and the structure is simple.

Continually referring to FIGS. 5 to 8, in an exemplary implementation, the counterweight mechanism 450 may further include a support base 453, and the support base 453 is used to support the drive wheel 452 and the resistance adjusting assembly 451. Specifically, the support base 453 includes a first support part 4531 and a second support part 4532 that are opposite to each other, the first support part 4531 includes a first installation hole 4533, and the second support part 4532 includes a second installation hole 4534. A bearing seat 4535 is installed in the first installation hole 4533, the bearing seat 4535 may be connected with the first support part 4531, an output shaft of the resistance adjusting assembly 451 is inserted into the second installation hole 4534, and the resistance adjusting assembly 451 is connected with the second support part 4532, the drive wheel 452 is located between the first support part 4531 and the second support part 4532, one side of the drive wheel 452 includes a connection shaft 4521, and the connection shaft 4521 is inserted into a bearing in the bearing seat 4535 so as to support the drive wheel 452 and the resistance adjusting assembly 451 through the support base 453. The support base 453 may be connected with the first bracket 100 or the second bracket 200.

In some embodiments, the pulling assembly 400 further includes a housing 460, the counterweight mechanism 450 and a part of the pulling piece 441 are located in the housing 460, the support base 453 may be connected with the housing 460, the housing 460 is connected with the first bracket 100 or the second bracket 200. Specifically, the housing 460 includes an entrance/exit hole 461, and a first end of the pulling piece 441 protrudes out of the housing 460 through the entrance/exit hole 461.

The bottom and/or side walls of the housing 460 include a sliding pad 410 or wheels 420. Therein, the wheels 420 may be universal wheels. By arranging the sliding pad 410 or the wheels 420 on the bottom of the housing 460, the sliding pad 410 or the wheels 420 help assist movement during the unfolding or folding process of the strength training machine, thereby facilitating the unfolding and folding of the strength training machine. The side wall of the housing 460 is provided with a sliding pad 410 or wheels 420. When the strength training machine is folded into upright state, the sliding pad 410 or the wheels 420 on the side wall of the housing 460 is in contact with the support surface of the strength training machine, thereby facilitating to move the strength training machine after folding.

Optionally, at least two foot pads 430 are provided on the bottom of the housing 460. When the strength training machine is in the unfolded state, the foot pads 430 are in contact with the support surface of the strength training machine to provide buffer for the strength training machine when the strength training machine is in use.

Figure 9:
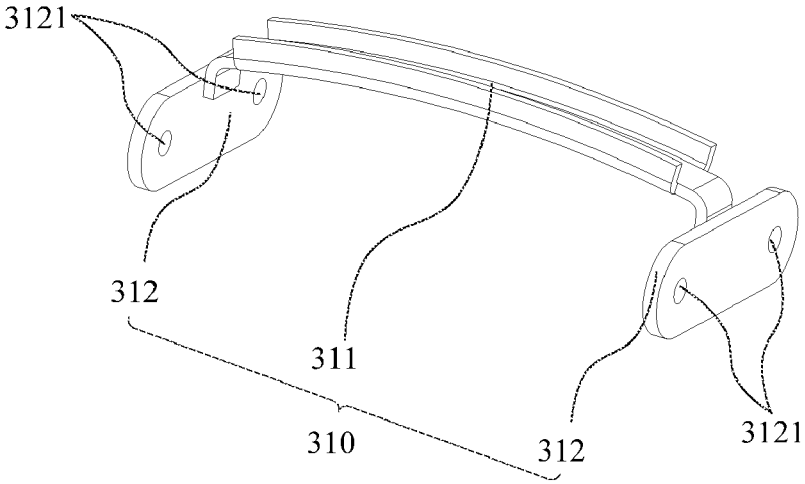
FIG. 9 is a structural diagram of a connection handle in the strength training machine provided by the embodiment of the present disclosure.

FIG. 9 is a structural diagram of the connection handle in the strength training machine provided by the embodiment of the present disclosure. Continually referring to FIGS. 1 to 3, and FIGS. 6 to 9, to facilitate the hinge connection of the first bracket 100 and the second bracket 200 with the connection handle 310, in some embodiments, the second end of the first bracket 100 includes at least two first connection pieces 130, and the second end of the second bracket 200 includes at least two second connection pieces 230. The connection handle 310 includes a handle main body 311, and both ends of the handle main body 311 include a connection part 312, and each the connection part 312 is respectively hinged with the first connection piece 130 and the second connection piece 230 that are opposite to each other, and there is a gap between the first connection piece 130 and the second connection piece 230 that are opposite to each other.

In the drawings of this embodiment, the number of the first connection pieces 130 and the number of the second connection pieces 230 are both four for illustration. It is understood that the number of the first connection pieces 130 and the second connection pieces 230 may also be greater than four. The four first connection pieces 130 and the four second connection pieces 230 are evenly and discretely spaced at the second end of the first bracket 100 and the second end of the second bracket 200, respectively. The second end of the first bracket 100 is opposite to the second end of the second bracket 200, and the first connection piece 130 and the second connection piece 230 are in one-to-one correspondence. The connection part 312 at the first end of the handle main body 311 may be respectively hinged with a first connection piece 130 and a second connection piece 230 in the middle that are opposite to each other, and the connection part 312 at the second end of the handle body 311 may be respectively hinged with another first connection piece 130 and another second connection piece 230 in the middle that are opposite to each other. Thus, the handle main body 311 is connected to the middle of the first bracket 100 and the second bracket 200, and when the strength training machine is folded with one hand, the force is relatively uniform and stable. Both sides of the handle main body 311 may be provided with circular chamfers, thereby providing a better hand feeling for the user and increasing the experience of the user.

Specifically, two first through holes 3121 may be provided on the connection part 312, and the second through holes 131 and the third through holes 231 are respectively provided on the first connection piece 130 and the second connection piece 230. A bolt 500 passes through the first through holes 3121 and the second through holes 131 respectively, to hinge the first connection piece 130 and the connection part 312, and another bolt 500 passes through the first through hole 3121 and the third through hole 231 respectively, to hinge the second connection piece 230 and the connection part 312. Therein, a part of the shaft of the bolt 500 is smooth, and a part thereof includes threads, and the smooth shaft is located in the first through hole 3121 and a part of the second through hole 131, or the smooth shaft is located in the first through hole 3121 and a part of the third through hole 231, thereby ensuring that the first bracket 100 and the second bracket 200 can rotate around the connection handle 310 smoothly. The second through hole 131 and the third through hole 231 may be stepped holes, the stepped holes can accommodate a nut 600, and the nut 600 and the threaded part of the bolt 500 are in threaded connection.

In this embodiment, there is a gap between the first connection piece 130 and the second connection piece 230, thereby avoiding interference between the first bracket 100 and the second bracket 200 during the folding process of the strength training machine. Therein, the opposite ends of the first connection piece 130 and the second connection piece 230 can be provided with chamfers, such as circular chamfers, which can also avoid interference between the first bracket 100 and the second bracket 200 during the folding process of the strength training machine.

To firmly connect the first bracket 100 and the second brackets 200 and prevent offsets of the first bracket 100 and the second bracket 200 when rotating around the connection handle 310, in some embodiments, the first connection assembly 300 includes two third connection pieces 320, and the third connection piece 320 is hinged with the first connection piece 130 and the second connection piece 230 that are located on an outer side.

Specifically, the first bracket 100 includes first connection pieces 130 on opposite sides, and the second bracket 200 includes second connection pieces 230 on opposite sides. One third connection piece 320 is hinged with a first connection piece 130 on the first side of the first bracket 100, and concurrently is hinged with a second connection piece 230 on the first side of the second bracket 200. Another third connection piece 320 is hinged with a first connection piece 130 on the second side of the first bracket 100, and concurrently is hinged with a second connection piece 230 on the second side of the second bracket 200. The hinged structures of the third connection piece 320 with the first connection piece 130 and the second connection piece 230 may be the same as those of the connection part 312 with the first connection piece 130 and the second connection piece 230, which will not be repeated herein.

In some embodiments, the first connection piece 130 and/or the second connection piece 230 on the outer side further includes a limiting piece 700. When the strength training machine is unfolded, the limiting piece 700 abuts against a side surface of the third connection piece 320 facing an upper surface of the first bracket 100 or an upper surface of the second bracket 200, thereby avoiding reversely folding the first bracket 100 and the second bracket 200, and meanwhile providing a position-limiting for unfolding the strength training machine. In an exemplary implementation, the limiting piece 700 may be a cylinder or a position limiting block.

During the folding process of the strength training machine, stress points are concentrated on the first connection piece 130 and the second connection piece 230, and therefore, a support piece 1000 can be provided to increase strength of the first connection piece 130 and the second connection piece 230. In particular, at least two adjacent first connection pieces 130 and at least two adjacent second connection pieces 230 are connected through the support piece 1000. Thus, the strength of the first connection piece 130 and the second connection piece 230 is increased, thereby preventing the deformation of the first connection piece 130 and the second connection piece 230 during the folding process of the strength training machine.

Figure 10:
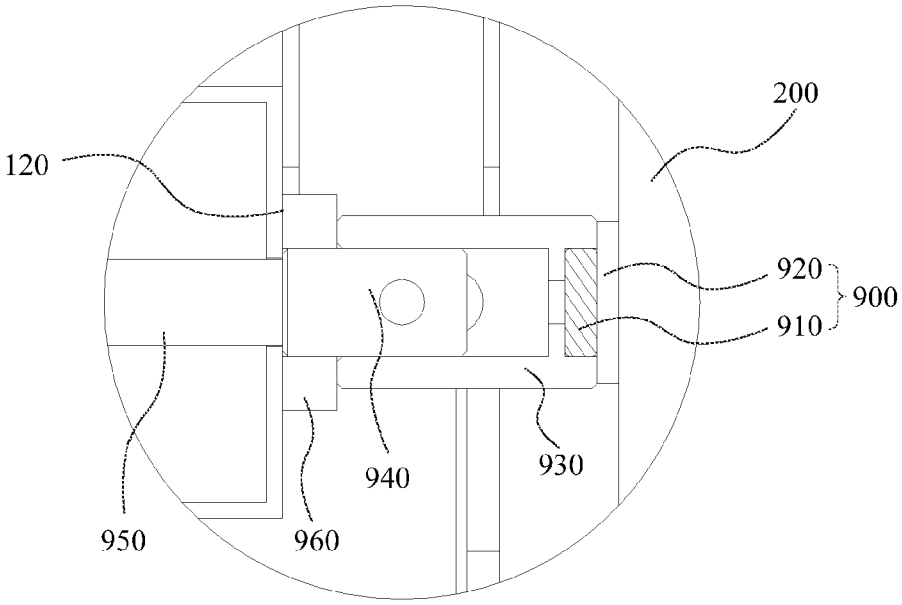
FIG. 10 is a partial enlarged view of A in FIG. 4.

FIG. 10 is a partial enlarged view of A in FIG. 4. Referring to FIGS. 4, 6, 8 and 10, the strength training machine provided by the embodiment of the present disclosure further includes a second connection assembly 900, which is used to connect the first bracket 100 and the second bracket 200 in the folded state to maintain the back to back arrangement of the first bracket 100 and the second bracket 200.

In one implementation, the second connection assembly 900 includes a magnetic element 910 and a magnetic adsorption piece 920, one of the magnetic element 910 and the magnetic adsorption piece 920 is located on the bottom of the first bracket 100, and the other one is located on the bottom of the second bracket 200. In the folded state, the magnetic element 910 is absorbed with the magnetic absorbing piece 920. For example, the magnetic element 910 can be a magnet, and the magnetic absorbing piece 920 can be an iron-made piece that can be absorbed by a magnet.

In the drawings of this embodiment, the magnetic element 910 is located on the bottom of the first bracket 100, and the magnetic adsorption member 920 is located on the bottom of the second bracket 200 for illustration. FIGS. 4 and 9, the second connection assembly 900 further includes a sleeve 930, a guide shaft 940, a positioning shaft 950 and a cushioning piece 960, the guide shaft 940 and the positioning shaft 950 are coaxially connected, and the guide shaft 940 is connected with the first bracket 100, for example, the first support rod 110 and the first connection rod 120 of the first bracket 100 may be connected with a support rib 140, and a support force is provided to the first bracket plate 150 through the support rib 140. The positioning shaft 950 may be connected with the first connection rod 120 or the support rib 140 that is on the first connection rod 120. The cushioning piece 960 and the sleeve 930 are sleeved on the guide shaft 940, the magnetic element 910 is connected with the first end of the sleeve 930, and the cushioning piece 960 abuts against the second end of the sleeve 930. When the strength training machine is in the folded state, the magnetic element 910 may drive the sleeve 930 to slide axially along the guide shaft 940, and the sleeve 930 may gradually release a pressure applied to the cushioning piece 960 until the magnetic element 910 is absorbed with the magnetic adsorption piece 920. When the strength training machine is in the unfolded state, the first end of the sleeve 930 abuts against the support surface (such as the ground) of the strength training machine, and the magnetic element 910 drives the sleeve 930 to slide axially along the guide shaft 940, so that the sleeve 930 abuts against the cushioning piece 960 and applies pressure to the cushioning piece 960 so that the sleeve 930 is flush with the bottom surface of the first bracket 100, thereby ensuring that the bottom surface of the first bracket 100 is in contact with the support surface of the strength training machine. Therein, the cushioning piece 960 may be one selected from the group of a foam pad, a rubber pad, or a spring.

In another implementation, the second connection assembly 900 includes a buckle (not shown) and a slot (not shown) matching the buckle. One of the buckle and the slot is located on the bottom of the first bracket 100, and the other one is located on the bottom of the second bracket 200. In the folded state, the buckle engages with the slot. By providing the slot and the buckle, it is convenient to connect the first bracket 100 and the second bracket 200 in the folded state, and it is also convenient to open the first bracket 100 and the second bracket 200 in the unfolded state, thereby facilitating operation and reducing cost.

Continually referring to FIGS. 1, 2, and FIGS. 4 to 7, the strength training machine provided by the embodiment of the present disclosure further includes a push rod structure 800, and the push rod structure 800 is located on one of the bottom of the first bracket 100 and the bottom of the second bracket 200. In the folded state, the limiting piece 700 is located above the third connection piece 320, and the push rod structure 800 can apply a pushing force to the other to separate the first bracket 100 and the second bracket 200. At this time, the user can grasp the connection handle 310 and slowly put down the first bracket 100 and the second bracket 200 until the first bracket 100 and the second bracket 200 contact with the support surface of the strength training machine, to level the first bracket 100 and the second bracket 200 and to make the limiting piece 700 abut against the third connection piece 320, so that the strength training machine can be unfolded with a single hand.

Hereinafter, the structure and use state of the push rod structure 800 will be described with an example of locating the push rod structure 800 on the bottom of the first bracket 100. It can be understood that the push rod structure 800 can also be located on the bottom of the second bracket 200.

In an exemplary implementation, the push rod structure 800 may include a drive assembly 810, a swing rod 820 and a support base 830. The drive assembly 810 and the support base 830 are connected with the first bracket 100, and the swing rod 820 is hinged with the support base 830. The drive assembly 810 is connected with the swing rod 820 to drive the swing rod 820 to rotate around the support base 830, so that the swing rod 820 applies a pushing force to the second bracket 200, thereby separating the first bracket 100 from the second bracket 200.

Therein, in the folded state, the first end of the swing rod 820 may abuts against the bottom of the second bracket 200. When the drive assembly 810 drives the swing rod 820 to rotate around the support base 830, the swing rod 820 rotates toward the second bracket 200, and provides a pushing force to the second bracket 200, to separate the first bracket 100 from the second bracket 200 to unfold the strength training machine.

The structure of the drive assembly 810 is not limited to those described in the present disclosure. For example, the drive assembly 810 may be a motor, the output shaft of the motor is connected with the swing rod 820, and the motor drives the swing rod 820 to rotate around the support base 830. When the drive assembly 810 is a motor, the supporting base 830 may not be provided, and the motor is connected with the first bracket 100. Therein, a drive button of the motor may be located at the second end of the first bracket 100 or the side surface of the first bracket 100, thus conveniently allowing the user to turn on and turn off the motor.

In some embodiments, the drive assembly 810 may include a pull rod 811, a pull cable 812 and a fixed base 813, the fixed base 813 is located at the second end of the first bracket 100, the pull rod 811 is inserted onto fixed base 813, the first end of the pull cable 812 is connected with the pull rod 811, and the second end of the pull rod 811 is connected with the second end of the swing rod 820. By applying a pulling force to the pull rod 811, the pull rod 811 may move relative to the fixed base 813, and the pull rod 811 drives the swing rod 820 to rotate around the support base 830 through the pull cable 812. The first end of the swing rod 820 rotates toward the second bracket 200 and provides a pushing force to the second bracket 200. Therein, the pull cable 812 is a steel wire rope, a steel strand, or a steel wire bundle.

In some embodiments, the support base 830 includes a positioning groove 831, the swing rod 820 is hinged in the positioning groove 831, and the positioning groove 831 is used to limit a rotation angle of the swing rod 820. For example, a notch of the positioning groove 831 faces the second end of the first bracket 100, the swing rod 820 may be V-shaped, the swing rod 820 is located in the positioning groove 831, and a bending position of the swing rod 820 is hinged with the positioning groove 831. The swing rod 820 rotates around the positioning groove 831 until it abuts against a bottom wall of the positioning groove 831, and at this time, the swing rod 820 cannot continue to rotate, thereby limiting the rotation angle of the swing rod 820. In this embodiment, the rotation angle of the swing rod 820 is not limited, as long as the swing rod 820 can separate the first bracket 100 from the second bracket 200.

In the present disclosure, the second connection assembly 900 is used to connect the first bracket 100 and the second bracket 200, and the push rod structure 800 is used to separate the first bracket 100 from the second bracket 200. The second connection assembly 900 and the push rod structure 800 may be adjacently disposed, whereby the push rod structure 800 facilitates the separation of the first bracket 100 and the second bracket 200.

Figure 11:
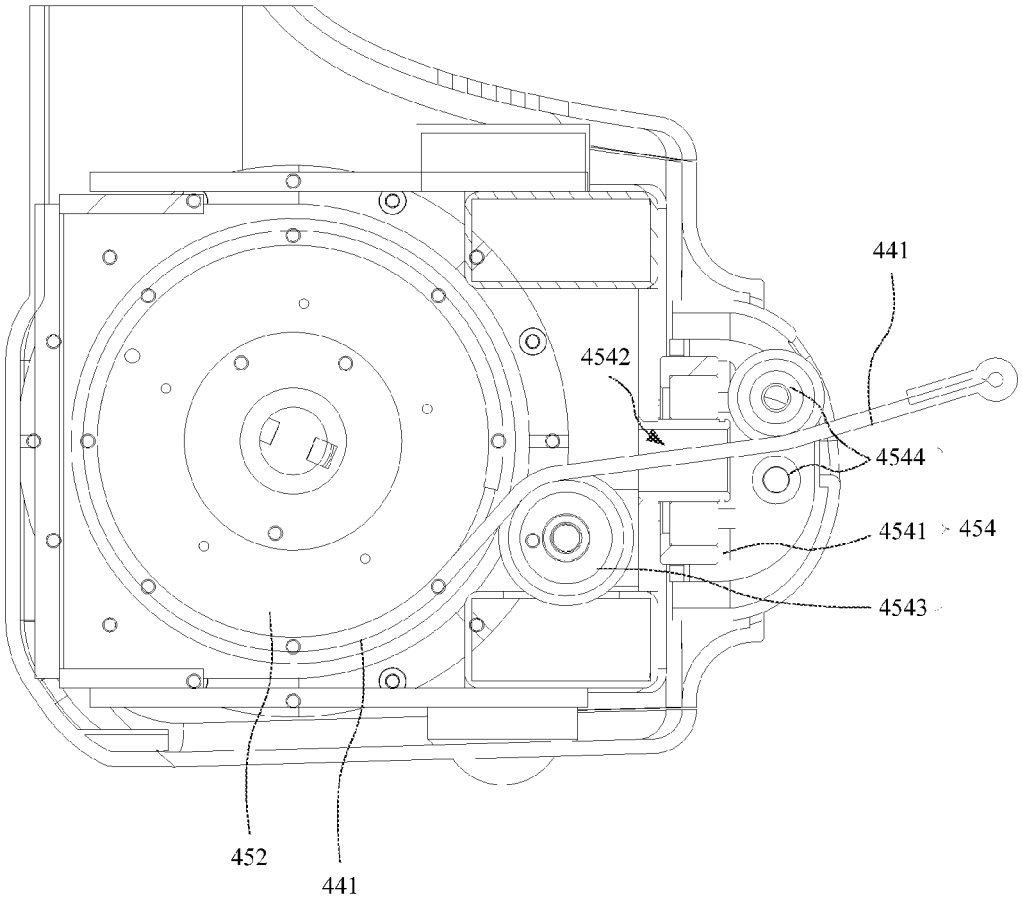
FIG. 11 is a partial enlarged view of B in FIG. 4.

FIG. 11 is a partial enlarged view of B in FIG. 4. Referring to FIGS. 1, 2, 4, 5 and 11, in the strength training machine provided by the present disclosure, the counterweight mechanism 450 further includes a guide unit 454, and the guide unit 454 includes a support frame 4541. The drive wheel 452 and the first end of the pulling piece 441 are respectively located on opposite sides of the support frame 4541, the support frame 4541 is provided with an avoidance hole 4542, and the pulling piece 441 is passed through the avoidance hole 4542.

Therein, the guide unit 454 may further include a first guide wheel 4543 and at least one second guide wheel 4544, the first guide wheel 4543 and the second guide wheel 4544 are supported on opposite sides of the pulling piece 441, the first guide wheel 4543 and the second guide wheel 4544 are respectively located on opposite sides of the support frame 4541, the drive wheel 452 and the first guide wheel 4543 are located on a same side of the support frame 4541, and the first end of the pulling piece 441 and the second guide wheel 4544 are located on a same side of the support frame 4541.

In the drawings of this embodiment, there are two second guide wheels 4544. After the pulling piece 441 is pulled out from the drive wheel 452, it is wound around the first guide wheel 4543, and then passes through the avoidance hole 4542 and the two second guide wheels 4544 in sequence, and then extends out of the housing 460 through the entrance/exit hole 461 of the housing 460. Thus, the pulling piece 441 is guided by the first guide wheel 4543 and the second guide wheel 4544, thereby avoiding the crimping of the pulling piece 441.

In an exemplary implementation, the pulling piece 441 may be a tension belt or a pull rope.

Figure 13:
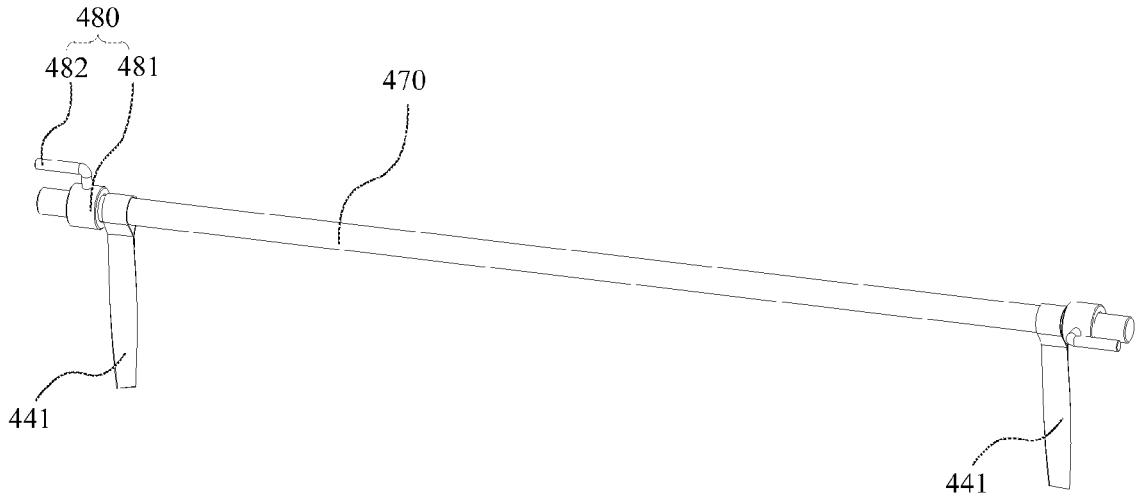
FIG. 13 is a structural diagram of a load bar, a fixing frame and a pulling piece in the strength training machine provided by the embodiment of the present disclosure.

FIG. 13 is a structural diagram of a load bar, a fixing frame and a pulling piece in the strength training machine provided by the embodiment of the present disclosure. Referring to FIGS. 12*a*, 12*b* and 13, in some embodiments, the pulling assembly 400 further includes a load bar 470, and the first ends of the two pulling pieces 441 are detachably connected with the load bar 470. By arranging the load bar 470, the user can perform squat training.

In order to prevent the pulling piece 441 from falling off from the load bar 470 when the load bar 470 is used, the pulling assembly 400 further includes at least two fixing assemblies 480, the fixing assemblies 480 are used to fix the first end of the pulling piece 441 on the load bar 470.

Therein, the fixing assembly 480 may include a fixing sleeve 481 and a fastening piece 482, the fixing sleeve 481 is sleeved on the load bar 470, and the fastening piece 482 is used to fix the fixing sleeve 481 on the load bar 470. Therein, the fastening piece 482 may be a screw rod, and the fixing sleeve 481 includes a screw-rod hole, and the screw rod is inserted into the screw-rod hole and abuts against the load bar 470 so as to fix the fixing sleeve 481 on the load bar 470, thereby enabling convenient disassembling and assembling of the fixing sleeve 481.

In some embodiments, only the fixing sleeve 481 is provided. The fixing sleeve 481 is provided with internal threads, and the load bar 470 is provided with external threads, and the fixing sleeve 481 and the load bar 470 are connected by threads. The fixing sleeve 481 and the load bar 470 may also be connected in a detachable manner commonly used by those skilled in the art, which is not limited in this embodiment.

In order to facilitate the user to use the strength training machine, the handle assembly 440 may further include a handle (not shown), the first end of the pulling piece 441 is provided with a pull ring (not shown), and the handle is detachably arranged on a pull ring. By arranging the pull ring, it is convenient to connect the first end of the pull rope with the handle. Therein, the handle and the pull ring can be connected by a detachable connection manner commonly used by those skilled in the art, such as a keychain. The user may hold the handle to apply a pulling force to the pull rope.

Finally, it should be noted that the above embodiments are only used to illustrate the technical solutions of the present disclosure, and are not intended to limit it. Although the present disclosure includes been described in detail with reference to the foregoing embodiments, those skilled in the art should understand that: it is still possible to modify the technical solutions described in the foregoing embodiments, or perform equivalent replacements for some or all of the technical features; and these modifications or replacements do not make the essence of the corresponding technical solutions deviate from the technical solutions of the various embodiments of the present disclosure.

What is claimed is:

1. A strength training machine, comprising: a first bracket, a second bracket and a first connection assembly, wherein a cavity of a first end of the first bracket and a cavity of a first end of the second bracket are provided with a counterweight mechanism, a bottom of the first end of the first bracket and a bottom of the first end of the second bracket are provided with a first sliding pad or wheels, and at least two foot pads, a side wall of the first end of the first bracket and a side wall of the first end of the second bracket are provided with a second sliding pad or wheels; the first connection assembly comprises a connection handle, a second end of the first bracket and a second end of the second bracket are connected through the connection handle; under an action of a force acted on the connection handle, the first bracket and the second bracket are switched between a folded state and an unfolded state; in the unfolded state, the two counterweight mechanisms are located in a same plane, the foot pads are in contact with a support surface of the strength training machine, the first sliding pad or wheels and the second sliding pad or wheels are without contact with the support surface; during a folding process, the first sliding pad or wheels are in contact with the supporting surface and slide, so that the first bracket and the second bracket are mutually folded; in the folded state, the second slide pads or wheels are in contact with the support surface and are capable of sliding.

2. The strength training machine according to claim 1, wherein the second end of the first bracket comprises at least two first connection pieces, the second end of the second bracket comprises at least two second connection pieces, the first connection pieces and the second connection pieces are in one-to-one correspondence; the connection handle comprises a handle main body, both ends of the handle main body comprise a connection part, each the connection part is respectively hinged with the first connection piece and the second connection piece that are opposite to each other, and there is a gap between the corresponding first connection piece and second connection piece.

3. The strength training machine according to claim 2, wherein at least two adjacent first connection pieces and at least two adjacent second connection pieces are connected through a support piece.

4. The strength training machine according to claim 2, wherein the first connection assembly further comprises two third connection pieces, and the two third connection pieces are hinged respectively with the first connection piece and the second connection piece that are located on an outer side.

5. The strength training machine according to claim 4, wherein at least one of the first connection piece or the second connection piece is provided with a limiting piece, and when the first bracket and the second bracket are folded reversely, the limiting piece abuts against the third connection piece, so as to avoid reversely folding the first bracket and the second bracket.

6. The strength training machine according to claim 1, wherein the first bracket comprises at least two first support rods and a first connection rod connected between the two first support rods, a first support plate is covered on the first support rods and the first connection rod; the second bracket comprises at least two second support rods and a second connection rod connected between the two second support rods, and a second support plate is covered on the second support rods and the second connection rod.

7. The strength training machine according to claim 1, wherein one of a bottom of the first bracket or a bottom of the second bracket is provided with a push rod structure, and the push rod structure is used to apply a pushing force to the other one, so as to separate the first bracket and the second bracket.

8. The strength training machine according to claim 7, wherein the push rod structure comprises a drive assembly, a swing rod and a support base that are connected in sequence, the drive assembly and the support base are arranged on one of the first bracket or the second bracket, and the drive assembly drives the swing rod to rotate around the support base, so that the swing rod applies a pushing force to the other one.

9. The strength training machine according to claim 8, wherein the drive assembly comprises a motor, and an output shaft of the motor is connected with the swing rod; or, the drive assembly comprises a pull rod, a pull cable and a fixed base, the fixed base is connected with the first bracket, the pull rod is inserted onto the fixed base, and the pull rod is connected with the swing rod through the pull cable.

10. The strength training machine according to claim 8, wherein a positioning groove is provided on the support base, the swing rod is hinged in the positioning groove, and the positioning groove is used to limit a rotation angle of the swing rod.

11. The strength training machine according to claim 1, further comprising: a second connection assembly, the second connection assembly comprises a magnetic element and a magnetic adsorption piece, one of the magnetic element or the magnetic adsorption piece is located on the first bracket, and the other one is located on the second bracket, and in the folded state, the magnetic element is absorbed with the magnetic adsorption piece; or, the second connection assembly comprises a buckle and a slot matching the buckle, one of the buckle or the slot is located on the first bracket, and the other one is located on the second bracket, and in the folded state, the buckle is engaged with the slot.

12. The strength training machine according to claim 11, wherein the second connection assembly further comprises a sleeve and a guide shaft, the guide shaft is connected with the first bracket or the second bracket, the sleeve are sleeved on the guide shaft, the magnetic element is connected with one end of the sleeve close to the magnetic adsorption piece, allowing the sleeve to slide along an axial direction of the guide shaft.

13. The strength training machine according to claim 1, wherein the first end of the first bracket and the first end of the second bracket are symmetrically provided with a pulling assembly, the pulling assembly comprises a handle assembly and the counterweight mechanism, the counterweight mechanism comprises a resistance adjusting assembly and a drive wheel, the handle assembly comprises a pulling piece, a first end of the pulling piece is used to allow an user to apply a pulling force, and a second end of the pulling piece is fixed on the drive wheel, and the drive wheel rotates under the driving of the resistance adjusting assembly, so that the pulling piece is wound on a wheel surface of the drive wheel and generates a counterweight pulling force.

14. The strength training machine according to claim 13, wherein the counterweight mechanism comprises a support base, the support base includes a first support part and a second support part that are opposite to each other, the first support part is connected with a bearing seat, the resistance adjusting assembly is connected with the second support part, and the drive wheel is located between the first support part and the second support part.

15. The strength training machine according to claim 14, wherein the first support part comprises a first installation hole, the second support part comprises a second installation hole, the bearing seat is installed in the first installation hole, and the second installation hole allows for an output shaft of the resistance adjusting assembly to pass through.

16. The strength training machine according to claim 13, wherein the counterweight mechanism further comprises a guide unit, the guide unit comprises a support frame, the drive wheel and the first end of the pulling piece are respectively located on opposite sides of the support frame, the support frame is provided with an avoidance hole, and the pulling piece is passed through the avoidance hole.

17. The strength training machine according to claim 16, wherein the guide unit further comprises a first guide wheel and at least one second guide wheel, the first guide wheel and the at least one second guide wheel are supported on opposite sides of the pulling piece, the first guide wheel and the at least one second guide wheel are respectively located on opposite sides of the support frame, the drive wheel and the first guide wheel are located on a same side of the support frame, the first end of the pulling piece and the at least one second guide wheel are located on a same side of the support frame.

18. The strength training machine according to claim 13, wherein the pulling piece is one of a tension belt or a pull rope.

19. The strength training machine according to claim 13, wherein the pulling assembly further comprises a load bar, and the first ends of the two pulling pieces are detachably connected with the load bar; or, the handle assembly further comprises a handle, the first end of the pulling piece is provided with a pull ring, and the handle is detachably arranged on the pull ring.

20. The strength training machine according to claim 19, characterized in that, the pulling assembly further comprises at least two fixing assemblies, and the at least two fixing assemblies are used to fix the first end of the pulling piece to the load bar.

* * * * *